United States Patent [19]

Modes

[11] 4,333,397

[45] Jun. 8, 1982

[54] CAN FLATTENING DEVICE

[76] Inventor: Edward E. Modes, 1417 Shawnee Trail, Deerfield, Ill. 60015

[21] Appl. No.: 218,298

[22] Filed: Dec. 19, 1980

[51] Int. Cl.[3] ..... B30B 1/04; B30B 7/00

[52] U.S. Cl. ..... 100/233; 100/295; 100/902

[58] Field of Search ..... 100/902, 233, 295

[56] References Cited

U.S. PATENT DOCUMENTS

| | | | |
|---|---|---|---|
| 2,614,604 | 10/1952 | Coffey | 100/902 |
| 2,800,160 | 7/1957 | Wilson et al. | 100/902 |
| 2,905,079 | 9/1959 | Brock | 100/902 |
| 3,009,414 | 11/1961 | Griemert | 100/902 |
| 3,667,386 | 6/1972 | Workman | 100/902 |
| 3,776,129 | 12/1973 | Carlson | 100/902 |
| 3,777,659 | 12/1973 | McCarten | 100/902 |
| 3,804,004 | 4/1974 | Krebs et al. | 100/902 |
| 3,853,054 | 12/1974 | Jacobsen | 100/902 |
| 3,901,141 | 8/1975 | Bochmann | 100/902 |
| 3,948,164 | 4/1976 | Pobuda et al. | 100/902 |
| 3,980,015 | 9/1976 | Woodard | 100/902 |
| 4,058,054 | 11/1977 | Markman | 100/902 |
| 4,088,072 | 5/1978 | Wittmeier | 100/902 |
| 4,120,190 | 10/1978 | Schlau et al. | 100/902 |

*Primary Examiner*—Billy J. Wilhite

*Attorney, Agent, or Firm*—Hosier, Niro and Daleiden

[57] ABSTRACT

A device is disclosed for individually flattening cylindrical containers, such as metal cans. A base is provided for supporting a can in a crushing position in which the can is disposed on its side on the base. A lever mechanism is pivotally attached to the base and is swingable upwardly therefrom to a raised position to permit a can to be positioned on its side on the base and downwardly toward the base for crushing the positioned can. The lever mechanism is jointed and includes a can engaging edge projecting from the joint whereby the edge is pivotable both about the pivot axis of the lever mechanism on the base and about the joint to effect crushing of one side of the can at one end thereof with the one end flattened over the crushed side. The partially flattened can then is turned over for similarly flattening the other side and other end thereof until the can is completely crushed into a flattened condition.

18 Claims, 8 Drawing Figures

CAN FLATTENING DEVICE

BACKGROUND OF THE INVENTION

This invention relates to devices for reducing containers, such as metal cans, to a condition of greatly reduced bulk in which they can be handled and shipped, and particularly to a can flattening device adapted for use in the household or similar environments.

Metal cans are widely used as economical containers for both food and beverages, and when the cans are empty they have become a considerable nuisance because of both the number and particularly the bulk thereof. If reduced in size for handling, they might be salvageable for scrap metal, for instance.

More and more importance presently is being attached to the conservation of natural resources and other products of our country. Specifically, the metal used in household containers such as cans can be recycled and reused. Continuing efforts are being made to pick-up and reprocess the metal in cans after having been used by the homeowner. However, it is somewhat difficult to store the cans and to process them for storage and shipment in compact fashions.

In addition, litter of the environment is an increasingly important problem. A significant portion of the litter is comprised of cans, the steel or "tin" can as well as the newer aluminum cans. In particular, aluminum cans are very slowly degradeable by natural errosion, corrosion and like conditions. To this end, some state governments have enacted laws to require a deposit on metal containers at the source of original purchase of the contained product, with a refund when the containers are returned. Such efforts, while being somewhat effective to slow the problem of littering of the environment, cause the additional problem to consumers in storing the containers, again because of both the number and particularly the bulk thereof. Even where such refund measures are not employed, the problem of unused metal cans is further magnified by many municipalities which have ordinances requiring that metal cans or containers be crushed or flattened after the contents have been removed in order that they may be disposed of easily. Even where the law does not require flattened cans, an individual is able to save considerable space in the home or elsewhere if a large receptacle is not needed for discarding the unused cans.

Sometimes one can manually crush a can but this is an unpleasant and rather dangerous action that may be objectionable, and some women and children simply cannot crush cans manually or do not wish to bother to do so within the household.

Consequently, many devices have been designed to provide can crushing apparatus for reducing the bulk of metal cans or containers. Most such prior devices employ a base or other means for supporting an individual can, with a lever arm pivoted to the base in order to physically crush and flatten the can. This general method of flattening cans involves a lever which swings to a hinge attachment at one end of a base such that it moves into a position approaching a generally parallel disposition with the upper surface of the base. Such lever action serves to flatten a can placed on such upper surface. However, these prior devices still require a considerable amount of force to be applied across the entire container length in order to crush and flatten the can. This is particularly true at the ends of the can which are rather rigid.

Some prior devices employ means for removing, initially crushing, or endwise fracturing the ends of the can in order to reduce the amount of force necessary to completely flatten the can. However, these devices normally utilize multiple components which result in increased expenses of manufacturing the devices.

Still, the major problems with prior can crushing or flattening devices concern the amount of force required to crush and flatten the cans, and the cost of the devices which should be available to parctically any household.

The present invention is directed to solving these problems by providing a new and improved, inexpensive and easily operable can crushing and flattening device.

SUMMARY OF THE INVENTION

An object, therefore, of the present invention is to provide a new and improved device for individually flattening cylindrical containers such as metal cans.

Another object of the invention is to provide a device of the character described which is quite inexpensive to manufacture.

A further object of the invention is to provide a device of the character described which greatly reduces the amount of force necessary to crush and flatten a container such as a cylindrical metal can.

Still another object of the present invention is to provide such a device which is capable of crushing cans of various sizes without adjustment.

In the exemplary embodiment of the invention, a base is provided for supporting a can in a crushing position in which the can is disposed on its side on a substantially flat can supporting surface of the base. Lever means is pivotally attached to the base and is swingable upwardly therefrom to a raised position to permit a can to be positioned on its side on the base and downwardly toward the base for crushing and flattening the positioned can. The lever means is jointed and includes a can engaging edge projecting from the joint whereby the edge is pivotable both about the pivot axis of the lever means on the base and about the joint to effect crushing of one side of the can at a crease adjacent one end thereof with the one end flattened over the side of the can. The partially flattened can then is turned over for similarly flattening the other side and other end thereof until the can is in a substantially flat, crushed condition. The pivot axis of the lever means on the base, the pivot axis of the lever means joint, and the can engaging edge all extend generally parallel to the flat can supporting surface of the base.

In particular, the lever means includes a first portion pivotally attached at one end thereof to the base and a second portion pivotally attached to the opposite end of the first portion. The pivot point of the second portion is disposed intermediate the ends thereof whereby the can engaging edge is formed by a projecting end of the second portion, and the opposite end of the second portion provides means for manual manipulation of the lever means. The first portion of the lever means comprises a pair of side arms joined by a generally flat upper plate. The upper plate is spaced from the pivot axis between the first and second portions a distance sufficient to capture said one end of the can between the flat upper plate and the can engaging edge during flattening of the can.

The base includes abutment means adjacent the pivot axis of the lever means for engaging the one end of the can and positioning the can during flattening thereof by the lever means. The can engaging edge of the lever means is rounded for crushing a can without cutting thereinto.

Thus, it can be seen that a new and improved device has been provided for individually flattening containers such as cylindrical metal cans. The novel jointed or articulated lever means provides a mechanical advantage to greatly reduce the forces necessary to crush and flatten a can. In addition, the device can be fabricated of three simple parts, such as metal or the like made in progressive dies, resulting in a very inexpensive device affordable by practically any individual.

Other objects, advantages and features of the invention will be apparent from the following detailed description taken in connection with the accompanying drawings.

DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE INVENTION

Figure 2:
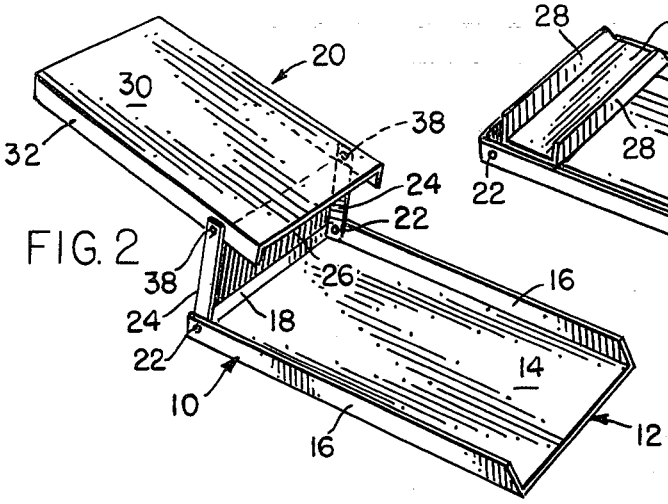
FIG. 2 is a perspective view of the device in open condition for receiving a container such as a cylindrical can.
Figure 1:
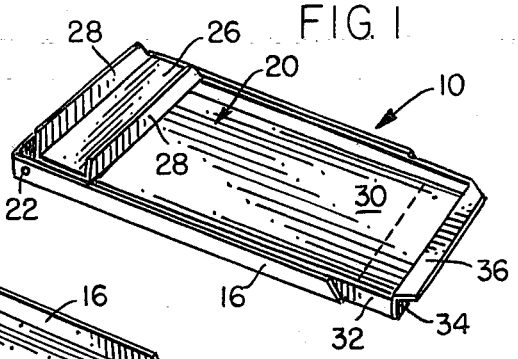
FIG. 1 is a perspective view of the device of the present invention in collapsed condition for storage.

Referring to the drawings in greater detail, and first to FIGS. 1 and 2, the device of the present invention, generally designated 10, is provided for individually flattening containers such as cylindrical metal cans. The device includes a base, generally designated 12, for supporting a can in a crushing position in which the can is disposed on its side on the base, as described in greater detail hereinafter. Base 12 includes a bottom wall 14, a pair of upstanding reinforcing flanges 16 extending along opposite sides of bottom wall 14, and an upstanding flange 18 at the rear of bottom wall 14 defining abutment means for engaging and positioning a can placed on bottom wall 14 of base 12.

Lever means, generally designated 20, is pivotally attached, as at 22, to base 12 at the rear of the upstanding side flanges 16 thereof. FIG. 1 shows device 10, including lever means 20, in substantially flat, collapsed condition for storage on a shelf, in a drawer, or other appropriate storage area. FIG. 2 shows device 10 with lever means 20 pivoted upwardly from base 12 to a raised position to permit a can to be positioned on its side on bottom wall 14 of the base. Lever means 20 is swingable downwardly toward the base for crushing and flattening a can, as described in greater detail hereinafter.

In particular, lever means 20 includes a first portion having a pair of side arms 24 joined by a generally flat upper plate 26. As seen in FIG. 1, a pair of reinforcing flanges 28 extend along the transverse edges of the flat upper plate 26. The first portion of lever means, namely side arms 24, are pivotally attached at the rear end of base 12, at 22 as described above. Lever means 20 includes a second portion 30 defined by a flat plate having reinforcing flanges 32 extending along opposite sides thereof. A front flange 34 (FIG. 1) extends transversely across the front of plate 30 and terminates therealong in an outwardly protruding lip 36 providing means for manual manipulation of lever means 20.

The second portion, comprising flat plate 30, of lever means 20 is pivotally attached to the outer ends of arms 24 of the first pivoted portion of lever means 20, as at 38. Thus, lever means 20 is jointed, as at pivots 38, with one end of plate 30 projecting beyond the joint to define a can engaging edge 40. With this jointed construction of lever means 20, can engaging edge 40 is pivotable both about the pivot axis 22 of lever means 20 on base 12 and about joint 38 to effect crushing and flattening of a can as described below.

Figure 3:
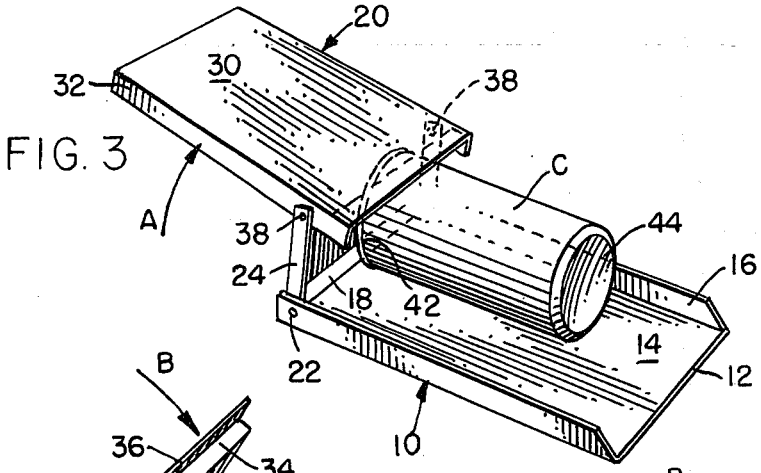
FIG. 3 is a perspective view similar to that of FIG. 2, with a cylindrical can positioned on the device about to be crushed and flattened thereby.

More particularly, referring to FIG. 3, device 10 is shown in the position of FIG. 2, with lever means 20 pivoted upwardly from base 12 to a raised position to permit a can C to be positioned on its side on bottom wall 14 of base 12. From this position, lever means 20 is rotated in the direction of arrow A until can engaging edge 40 engages a top side of can C.

Figure 4:
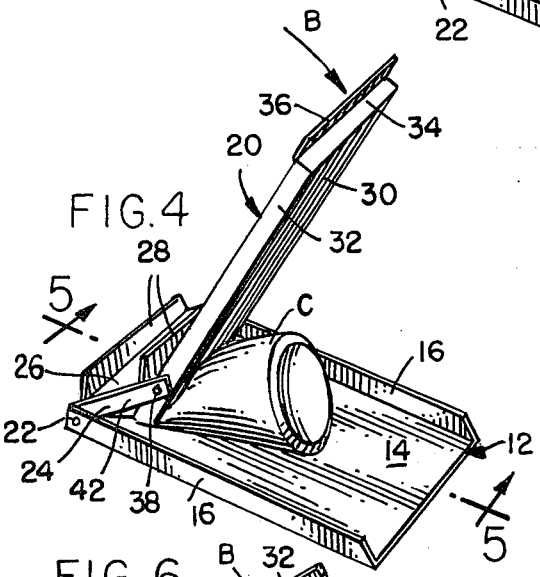
FIG. 4 is a sequential view of the device illustrating the device initially creasing one side of a can adjacent one end thereof.
Figure 5:
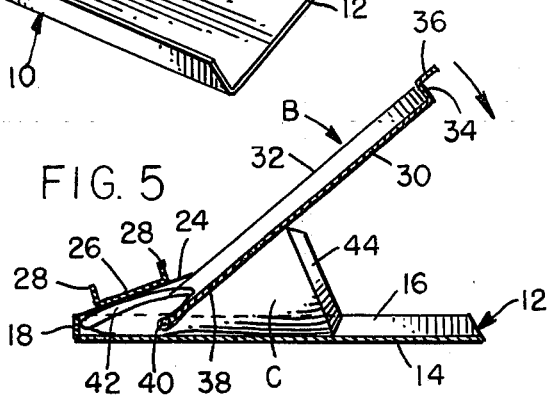
FIG. 5 is a sectional view taken generally along the line 5—5 of FIG. 4, illustrating one side of a can completely crushed to the extent contemplated by the present invention.

Referring to FIGS. 4 and 5, lever means 20 is pivoted in the direction of arrows B from the position shown in FIG. 3 to cause can engaging edge 40 to engage, crease and crush one side of can C adjacent one end 42 thereof until the one end is generally flattened over the creased side of the can as shown best in FIG. 5. It can be seen that upstanding flange 18 at the rear of bottom wall 14 of base 12 provides an abutment means adjacent pivot axis 22 for engaging end 42 of can C. This abutment provides a reaction against the forces applied by the can engaging edge 40 of the lever means. It also should be noted that pivot axis 22 of lever means 20 on base 12; pivot axis or joint 38 of lever means 20; can engaging edge 40; and abutment flange 18 all extend generally parallel to the flat can supporting surface defined by bottom wall 14 of base 12. This entire parallel relationship between the parts eliminates binding by any possible cross or angular forces which might detract from the ease of manipulation of the device.

Figure 6:
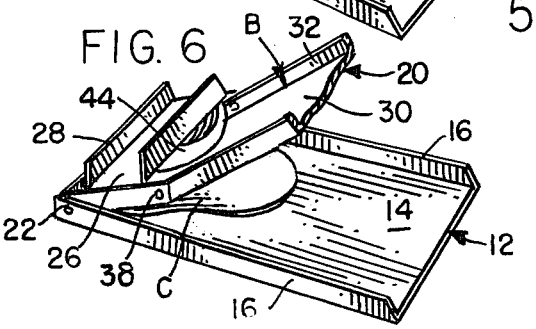
FIG. 6 is a fragmented perspective view of the device with the can as previously crushed in FIG. 5 turned over and the other side of the can being crushed by the device.
Figure 7:
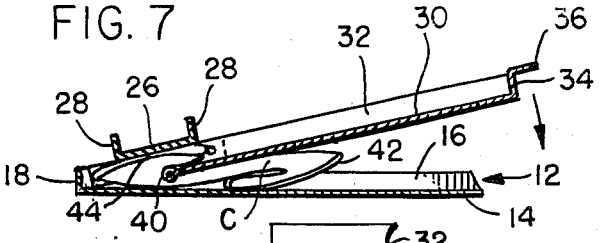
FIG. 7 is a sectional view of the device, taken similarly as FIG. 5, with the partially crushed can of FIG. 6 completely crushed and flattened by the device of the present invention.

After one side of can C is creased and crushed to the extent shown in FIG. 5, lever means 20 is pivoted opposite the direction of arrows B to release the can, whereupon the can is turned over so that the end 44 thereof is positioned in abutment with rear flange 18 of base 12. The above creasing and crushing operation described in relation to FIGS. 4 and 5 then is repeated as shown in FIG. 6 until the entire can is substantially flattened to the condition shown in FIG. 7. In this condition, the flattened can assumes on the order of one-third the bulk of a non-flattened can as shown in FIG. 3, yet the length of the crushed can is no longer than that of the can before crushing. As seen best in FIG. 6, the end of can C which is being crushed (end 44 in FIG. 6) is captured or sandwiched between top plate 26 and flat plate 30 to further enhance the flattening capabilities of the device of the present invention.

Figure 8:
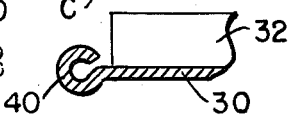
FIG. 8 is a fragmented section, on an enlarged scale, through the can engaging edge of the lever means of the present invention.

It can be seen that device 10 of the present invention is fabricated of three simple components: namely, base 12, and the two jointed portions of lever means 20. Each of these parts can be fabricated from sheet metal, or the like, in simple press work operations in progressive dies. The parts then can be simply and inexpensively assembled by four tubular rivets to define pivot axis 22 between base 12 and lever means 20 as well as joint 38 of the articulated lever means. To this end, referring to FIG. 8, it can be seen that can engaging edge 40 along one end of flat plate 30 of the lever means 20 can be rounded for crushing a can without cutting thereinto. In addition, this rounded edge increases the strength thereof and is highly stressed in bending. The rounded edge increases the section modulus and thus increases rigidity.

Thus, it can be seen that a new and improved device 10 has been provided for individually flattening containers such as cylindrical metal cans C by means of a very inexpensive fabrication of parts which can be made affordable to any household. The jointed construction of lever means 20 provides a mechanical advantage to permit cans to be crushed and substantially flattened with a minimum amount of manual forces. In addition, the device is capable of crushing cans of various sizes without adjustment due to the range of articulation of the jointed lever means.

It will be understood that the invention may be embodied in other specific forms without departing from the spirit or central characteristics thereof. The present examples and embodiments, therefor, are to be considered in all respects as illustrative and not restrictive, and the invention is not to be limited to the details given herein.

I claim:

1. A device for individually flattening cylindrical cans, comprising:

a base for supporting a can in a crushing position in which the can is disposed on its side on said base; and lever means pivotally attached to said base, said lever means being swingable upwardly from said base to a raised position to permit a can to be positioned on its side on said base and downwardly toward said base for crushing the positioned can, said lever means being jointed and including a can engaging edge projecting from the joint whereby the edge is pivotable both about the pivot axis of said lever means on the base and about said joint to effect crushing of one side of the can at a crease adjacent one end thereof with said one end flattened over said one side, the partially flattened can then being turned over for similarly flattening the other side and other end thereof.

2. The device of claim 1 wherein said base has a substantially flat can supporting surface.

3. The device of claim 2 wherein the pivot axis of said lever means on the base, the pivot axis of said joint, and said can engaging edge all extend generally parallel to said flat can supporting surface of said base.

4. The device of claim 1 wherein said base includes means for engaging and positioning a can during said flattening thereof by said lever means.

5. The device of claim 4 wherein said engaging and positioning means comprises abutment means for engaging said one end of the can.

6. The device of claim 5 wherein said abutment means is disposed adjacent the pivot axis of said lever means.

7. The device of claim 1 wherein said can engaging edge is rounded for crushing a can without cutting thereinto.

8. The device of claim 1 wherein said lever means comprises a first portion pivotally attached at one end thereof to said base and a second portion pivotally attached to the opposite end of said first portion, the pivot point of said second portion being disposed intermediate the ends thereof whereby said can engaging edge is formed by a projecting end of said second portion, and the opposite end of said second portion provides means for manual manipulation of said lever means.

9. The device of claim 8 wherein said first portion of said lever means comprises a pair of side arms joined by a generally flat upper plate which is spaced from the pivot axis between said first and second portions a distance sufficient to capture said one end of the can between said flat upper plate and said can engaging edge during flattening of the can.

10. The device of claim 8 wherein said base has a substantially flat can supporting surface.

11. The device of claim 10 wherein the pivot axis of said lever means on the base, the pivot axis of said joint, and said can engaging edge all extend generally parallel to said flat can supporting surface of said base.

12. The device of claim 8 wherein said base includes abutment means adjacent the pivot axis of said lever means for engaging said one end of the can.

13. A device for individually flattening cylindrical cans, comprising:

a base having a generally flat wall for supporting a can in a crushing position in which the can is disposed on its side on said flat wall; and lever means pivotally attached to said base and swingable upwardly therefrom to a raised position to permit a can to be positioned on its side on said flat wall of said base and downwardly toward said flat wall for crushing the positioned can, said lever means being jointed and including a first portion pivotally attached at one end thereof to said base and a second portion pivotally attached to the opposite end of said first portion, the pivot point of said second portion being disposed intermediate the ends thereof to define a can engaging edge formed by a projecting end of said second portion and the opposite end of said second portion provides means for manual manipulation of said lever means, whereby said can engaging edge is pivotable both about the pivot axis of said lever means on said base and about the pivot axis between said first and second portions of said lever means to effect crushing of one side of the can at a crease adjacent one end thereof with said one end flattened over said one side, the partially flattened can then being turned over for similarly flattening the other side and other end thereof.

14. The device of claim 13 wherein said first portion of said lever means comprises a pair of side arms joined by a generally flat upper plate which is spaced from the pivot axis between said first and second portions a distance sufficient to capture said one end of the can between said flat upper plate and said can engaging during flattening of the can.

15. The device of claim 13 wherein said base includes abutment means adjacent the pivot axis of said lever means on said base for engaging said one end of the can and positioning the can during said flattening thereof by said lever means.

16. The device of claim 13 wherein said can engaging edge is rounded for crushing a can without cutting thereinto.

17. The device of claim 13 wherein said second portion of said lever means is defined by a generally flat plate for engaging the side of the can opposite said flat wall of said base.

18. The device of claim 13 wherein the pivot axis of said lever means on said base, the pivot axis of said jointed lever means, and said can engaging edge all extend generally parallel to said flat wall of said base.

* * * * *